United States Patent [19]

Rothenbucher

[11] 4,262,741

[45] Apr. 21, 1981

[54] HEADER SUPPORT FOR HEAT EXCHANGER

[76] Inventor: Robert K. Rothenbucher, 6617 S. 92 E. Ave., Tulsa, Okla. 74133

[21] Appl. No.: 47,134

[22] Filed: Jun. 11, 1979

[51] Int. Cl.[3] ..... F28F 9/00; F16L 3/08

[52] U.S. Cl. ..... 165/68; 165/82; 165/162; 165/178; 248/73; 248/232

[58] Field of Search ..... 165/67, 68, 81, 82, 165/162, 178; 248/232, 233, 73, DIG. 1

[56] References Cited

U.S. PATENT DOCUMENTS

| | | | |
|---|---|---|---|
| 2,793,007 | 5/1957 | Reynolds | 165/67 |
| 2,796,238 | 6/1957 | Sjoden | 165/67 |
| 2,963,276 | 12/1960 | Nelson | 165/82 |
| 3,168,356 | 2/1965 | Yama | 165/82 |
| 3,318,409 | 5/1967 | Kiehnle | 165/67 |
| 3,339,630 | 9/1967 | Schlentner et al. | 165/82 |
| 3,368,614 | 2/1968 | Anderson | 165/82 |
| 3,369,595 | 2/1968 | Nelson | 165/82 |
| 3,386,501 | 6/1968 | Pastore | 165/82 |
| 3,494,414 | 2/1970 | Warner | 165/82 |

*Primary Examiner*—James C. Yeung
*Assistant Examiner*—Daniel O'Connor
*Attorney, Agent, or Firm*—Head & Johnson

[57] ABSTRACT

A means for supporting a heat exchanger formed of spaced apart headers with finned tubes extending therebetween, the headers being supported between parallel opposed structural members, the support means including brackets having horizontal portions on which each of the headers rests and clip affixed to the headers adjacent each bracket, each clip having a horizontal portion extending below and parallel the brackets, and stops adjacent the clips to limit the horizontal movement of the headers.

1 Claim, 3 Drawing Figures

HEADER SUPPORT FOR HEAT EXCHANGER

BACKGROUND OF THE INVENTION

1. Field of the Invention

The invention relates to heat exchangers and more particularly to apparatus for supporting a heat exchanger formed of opposed headers with finned tubes extending therebetween, the heat exchanger being supported between spaced paralleled horizontal structural members. The invention is specifically directed to means for supporting the heat exchanger in a manner such as to permit limited movement of the headers but to prevent the heat exchangers from being displaced from their structural supports.

2. Description of the Prior Art

Heat exchangers have been attached to supporting structures in a variety of ways. In transporting a heat exchanger from the point of manufacture to the point of installation the exchanger must be securely anchored to its structural support. For this reason a typical means of mounting a heat exchanger header to a supporting structure is the use of bolts. The typical heat exchanger includes opposed parallel headers with finned tubes therebetween arranged for air to be drawn through the finned tube. Thus each header must be bolted to the structure which supports it during shipment. A common pratice is to bolt both headers of the heat exchanger with instructions that the bolt from one of the headers must be removed before the exchanger is placed into operation to allow for contraction and expansion of the heat exchanger tubes. The finned tubes extending between headers expand when the hot liquids flow through them. If both headers are bolted securely, the tubes will buckle, causing them to fail.

It is therefore an object of this invention to provide an improved means of anchoring a heat exchanger to its supporting structures.

More particularly, an object of this invention is to provide means for anchoring a heat exchanger comprised of opposed parallel headers with horizontal finned tubes extending therebetween arranged in such a way that the headers are not bolted or welded to their supporting structure but are free-floating to allow for expansion and contraction of the finned tubes while nevertheless maintaining the heat exchanger securely affixed to its supporting structure.

These general objects as well as other and more specific objects of the invention will be fulfilled in the following description and claims, taken in conjunction with the attached drawings.

SUMMARY OF THE INVENTION

A means for supporting a heat exchanger between spaced apart parallel horizontal structural members is provided. The heat exchanger has a header at each end with a plurality of transversely extending horizontal finned tubes. The invention provides means of supporting the headers to structural members so that the headers are free-floating and yet secured to the supporting structure. A pair of horizontal brackets is affixed at each end of the opposed parallel structural members. Each bracket has a horizontal portion. The bracket horizontal portions are all in a common horizontal plane. Each exchanger header rests on an opposed pair of the horizontal brackets. An L-shaped clip member is provided for each of the brackets. Each clip member has a vertical portion and a horizontal portion. The top end of each vertical portion is affixed to a header adjacent to and inwardly of each of the bracket horizontal portions. Each clip member has a horizontal portion lower edge and extending integrally from the clip vertical portion lower edge and extending in a direction towards the bracket. A stop means is affixed to each bracket horizontal portion adjacent a clip member, limiting the horizontal movement of the clip member. The exchanger headers are thereby each free-floating and capable of sliding on the horizontal brackets. Nevertheless, the headers are prevented from disengagement with the brackets by the clip members and are prevented from horizontal displacement by the stop members.

BRIEF DESCRIPTION OF THE VIEWS

DETAILED DESCRIPTION

Figure 1:
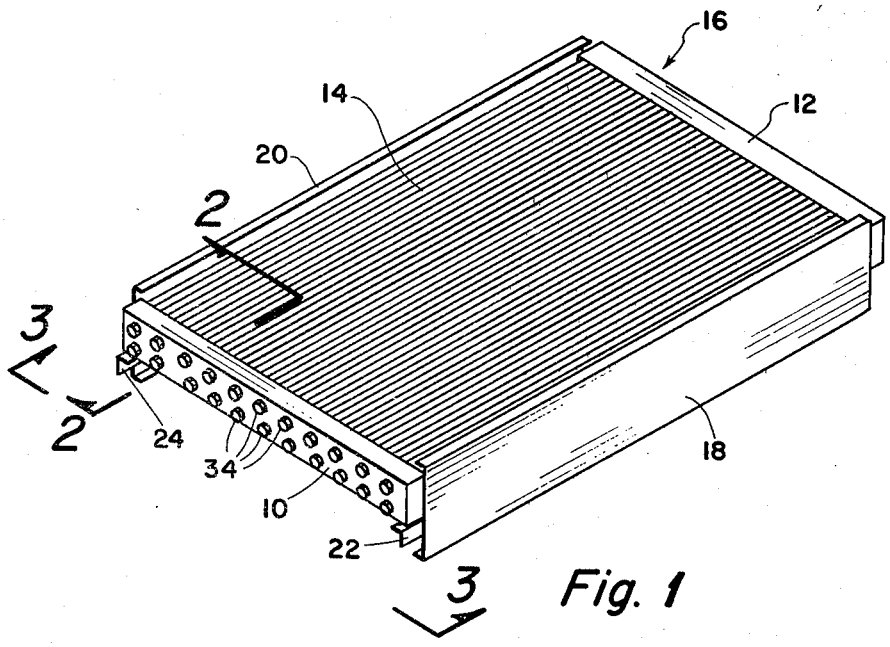
FIG. 1 is a perspective view of a heat exchanger showing opposed headers with a plurality of finned tubes extending horizontally therebetween and showing the headers and finned tube supported by parallel structural members.

Referring to the drawings and first to FIG. 1, a heat exchanger is shown which includes a first header 10 and a second header 12. The headers are supported horizontally relative to the earth and parallel and spaced apart from each other. Extending between headers 10 and 12 are a plurality of finned tubes 14. In a typical heat exchanger, heated fluid flows into one of the headers 10 or 12, flows through finned tubes 14, and out the other header. The heat exchanger is normally mounted so that air moved by a fan (not shown) is passed through the finned tubes 14 so that the temperature of the fluid flowing through the heat exchanger can be altered by exchange of heat with the air. Fluid as used herein means liquids or gases.

Coupling means (not shown) at headers 10 and 12 are arranged to connect piping for passing fluid into one of the headers and away from the other. The pair of headers 10 and 12 and the interconnecting finned tubes 14 are formed together as an integral unit and are referred to as a heat exchanger generally indicated by the numeral 16.

Since finned tubes 14 are usually formed of fairly thin-walled material so as to increase the rate of heat exchange, it is necessary that the heat exchanger be firmly structurally supported. At the same time the structural support must not obstruct the free flow of air past the finned tubes 14. For this reason, structure members extend along each side of the heat exchanger. In the illustrated arrangement the first structural member 18, in the form of a wide channel, extends along one side of the heat exchanger, and an opposed paralleled horizontal second structural member 20 extends along the other side. These channel structural members 18 and 20 give rigidity and support for the heat exchanger. The object of the present invention is to provide an improved means of supporting the headers 10 and 12 of the heat exchanger to the structural members 18 and 20. To illustrate the means whereby this is accomplished, reference may now be had to FIGS. 2 and 3.

Each of the structural members 18 and 20 includes a vertical portion 18A and 20A respectively. Affixed to the vertical portion 18A of structural member 18, at each end thereof, is an L-shaped horizontal bracket 22. In like manner, affixed to each end of the vertical portion 20A of the other structural member is a bracket 24. While there is a bracket 22 and 24 affixed to each end of both structural members 18 and 20, only the brackets at one end are seen in FIG. 1 and illustrated in FIG. 3 for supporting header 10, it being understood that similar brackets are fixed to the structural members on the opposite end for supporting header 12. The horizontal brackets 22 and 24 are each of L-shaped configuration. Bracket 22 has a horizontal portion 22A having an inner edge 22B. In like manner, bracket 24 has a horizontal portion 24A and an inner edge 24B. Header 10 rests on the bracket horizontal portions 22A and 24A. The four support brackets, only 22 and 24 being illustrated, each have horizontal portions in a common horizontal plane.

Affixed to header 10 are a pair of L-shaped clip members 26 and 28. Clip member 26 has a vertical portion 26A, the top end of which is affixed to the header 10, such as by welding. The clip member is located adjacent the support bracket inner edge 22B. Clip member 26 has a horizontal portion 26B which integrally extends from the vertical portion lower edge and extends in the direction towards structural member 18 to which bracket 22 is attached. The clip member horizontal portion 26B extends below, parallel to, spaced from, and in overlapping relationship with bracket horizontal portion 22A.

Figure 3:
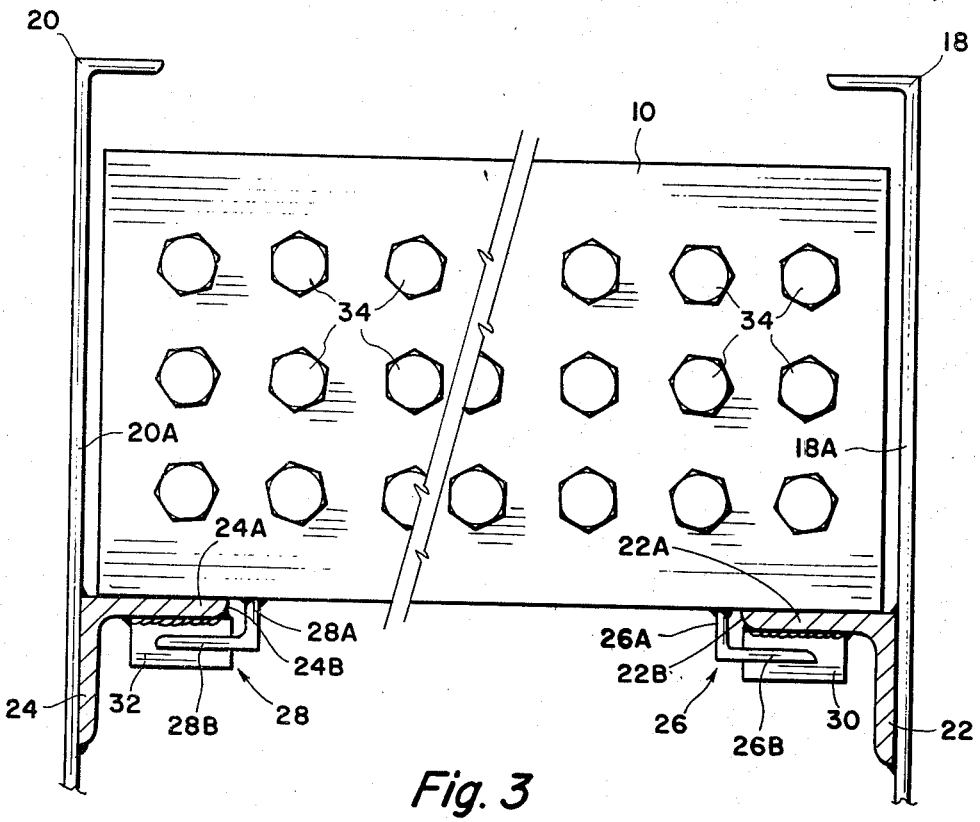
FIG. 3 is an end view taken along the line 3—3 of FIG. 1, greatly englarged compared to FIG. 1, and with center portion of the header cut away, showing the means for mounting the heat exchanger according to this invention.

In like manner, clip member 28 has a vertical portion 28A, the upper edge of which is welded to header 10. Extending integrally from the lower edge of the vertical portion 28A is the clip member horizontal portion 28B, which extends below, spaced from, parallel to, and in overlapping relationship with the bracket horizontal portion 24A. While not shown, it is understood that a pair of clip members is affixed to header 12 in the same relationship as shown in FIG. 3. Thus there are two pairs of horizontal brackets (one pair consisting of brackets 22 and 24 being shown) and two pair of clip members (only one pair consisting of members 26 and 28 being shown).

Secured to the lower surface of bracket horizontal member 22A is a stop member 30. It is secured such as by welding and is spaced adjacent to and a slight distance from clip member horizontal portion 26B. In like manner, a stop member 32 is welded, or otherwise affixed, to bracket horizontal portion 24A adjacent and spaced from clip member horizontal portion 28B. It is understood that similar stop members are positioned adjacent the clip members affixed to header 12. In the illustrated arrangement the stop members are inwardly of clip members. It can be seen that the stop members could be positioned outwardly of the clip members; however, in order for the apparatus to function properly, all of the stop members should be positioned either inwardly or all outwardly of the clip members.

Figure 2:
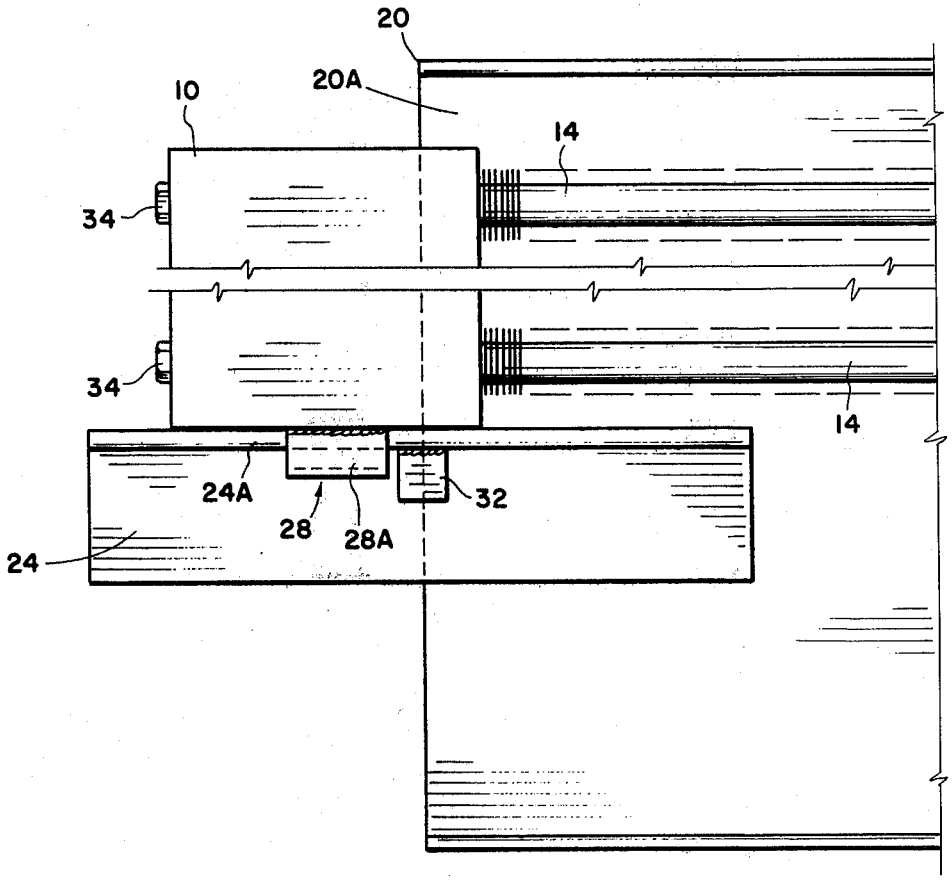
FIG. 2 is an enlarged cross-sectional view taken along the line 2—2 of FIG. 1 showing the means of supporting the heat exchanger according to this invention.

Referring specifically to FIG. 2, it can be seen that header 10 slidably rests on the horizontal portion 24A of support bracket 24. Any expansion or contraction in the length of finned tubes 14 will cause the header to slide on the bracket portion 24A. Clip member 28 will not interfere in any way with this sliding action so that thereby the headers 10 and 12 are free-floating. At the same time, however, the clip members prevent the headers from becoming disengaged from the support brackets. The provision of stop members, such as member 32 illustrated in FIG. 2, prevents the heat exchanger from being displaced horizontally beyond limits relative to the supporting structural members.

Thus the apparatus disclosed herein achieves the objectives initially set forth for the invention. Means are provided for anchoring the heat exchanger to supporting structure so that the heat exchanger is securely supported by the structure but is free-floating, yet restrained within limits so that it cannot become disengaged from its supporting structure. The method of mounting the heat exchanger on a supporting structure can be completed during the fabrication of the heat exchanger in the manufacturing facility. When the heat exchanger, including its supporting structure, arrives after transportation to the point of installation, no instructions are necessary to the installer regarding the mounting arrangement. In other words, unlike previous methods wherein the headers 10 and 12 are bolted or otherwise secured to supporting structures and at least one of the headers must be unfastened from rigid connection to the supporting structures to allow for contraction and expansion, in the present arrangement, no unfastening is required. This eliminates the possibility of failure of the heat exchanger through oversight during installation.

Plugs 34 are usually provided in headers in alignment with the finned tubes 14 to enable the tubes to be cleaned out. FIGS. 1 and 2 illustrate two levels of finned tubes 14 and plugs 34, while FIG. 3 illustrates three levels. The number of levels of finned tubes and clean-out plugs may vary, and the actual configuration of the other heat exchanger and structural components may be different from those illustrated herein for purpose of exemplification without changing the scope of the invention.

The invention achieves advantages over the existing method of supporting headers for heat exchangers. The improved means of supporting the headers provides, in addition to the advantages previously mentioned, the following:

(a) The headers are prevented from being vertically upwardly displaced, such as may be caused by a thermal pipe expansion of pipes connected to the headers (not shown in the drawing) by the provision of clip members 28;

(b) The headers are free-floating within limits to move not only longitudinally as has been described, but are permitted limited lateral movement between the horizontal portions 18A and 20A of structural members 18, thereby making the heat exchanger more or less free floating as it is supported between these structural members; and (c) Both headers of the heat exchanger are permitted to move laterally compared to the previous techniques of firmly attaching one header and permitting only one header to move, thereby decreasing the stress applied to the tubes during thermal changes.

It is understood that the invention is to be limited only by the scope of the attached claim or claims, including the full range of equivalency to which each element thereof is entitled.

What is claimed is:

1. Means for supporting a heat exchanger between a pair of spaced apart, paralleled horizontal structural members, each having a vertical portion, the heat exchanger having a header at each end extending transversely of the structural members, the support means comprising:

a bracket affixed at each end of each of the exchanger structural members, each bracket having a horizontal portion and the bracket horizontal portions being in a common horizontal plane, each horizontal portion having an inner edge, the exchanger headers resting on the horizontal portions of the brackets;

a clip member for each of said brackets, each clip member having a vertical portion with a top and bottom end and a horizontal portion, the top end of each vertical portion being affixed to a header adjacent to and inwardly of its said bracket horizontal portion inner edge, and each clip member having a horizontal portion integrally extending from the vertical portion lower end and extending in the direction towards the structural member to which the adjacent horizontal bracket is attached and each clip member horizontal portion extending below, parallel to, spaced from, and in overlapping relationship; and a stop member affixed to each said bracket horizontal portion adjacent each said clip members limiting the horizontal movement of said clip members.

* * * * *